US005795651A

United States Patent [19]

Matsuoka et al.

[11] Patent Number: 5,795,651

[45] Date of Patent: *Aug. 18, 1998

[54] FILAMENT HAVING PLEXIFILAMENTARY STRUCTURE, NONWOVEN FABRIC COMPRISING SAID FILAMENT AND THEIR PRODUCTION

[75] Inventors: Fumio Matsuoka; Shigemitsu Murase; Koichi Nagaoka; Hiroshi Nishimura, all of Kyoto, Japan

[73] Assignee: Unitika, Ltd., Hyogo, Japan

[ * ] Notice: The term of this patent shall not extend beyond the expiration date of Pat. No. 5,786,284.

[21] Appl. No.: 814,665

[22] Filed: Mar. 11, 1997

Related U.S. Application Data

[63] Continuation of Ser. No. 791,344, Jan. 31, 1997, and a continuation-in-part of Ser. No. 577,244, Dec. 22, 1995, abandoned, which is a division of Ser. No. 341,608, filed as PCT/JP94/00581 Apr. 6, 1994, abandoned.

[30] Foreign Application Priority Data

| | | | |
|---|---|---|---|
| Apr. 8, 1993 | [JP] | Japan | 5-81584 |
| Apr. 8, 1993 | [JP] | Japan | 5-81585 |
| May 6, 1993 | [JP] | Japan | 5-104870 |

[51] Int. Cl.[6] ..... D02G 3/00

[52] U.S. Cl. ..... 428/364; 428/357

[58] Field of Search ..... 428/364, 357

[56] References Cited

U.S. PATENT DOCUMENTS

| | | |
|---|---|---|
| 3,081,519 | 3/1963 | Blades et al. . |
| 3,227,794 | 1/1966 | Anderson et al. . |
| 3,361,848 | 1/1968 | Sigget et al. . |
| 3,616,160 | 10/1971 | Winchinofer . |

(List continued on next page.)

FOREIGN PATENT DOCUMENTS

| | | |
|---|---|---|
| A-0 093 021 | 11/1983 | European Pat. Off. . |
| A-2 246 661 | 5/1975 | France . |
| 52-85513 | 7/1977 | Japan . |
| 53-109536 | 9/1977 | Japan . |
| 55-16906 (A) | 2/1980 | Japan . |
| 61-160476 (A) | 7/1986 | Japan . |
| 1-132819 (A) | 5/1989 | Japan . |
| 2-139416 (A) | 5/1990 | Japan . |
| 2-221448 (A) | 9/1990 | Japan . |
| 3-69613 (A) | 3/1991 | Japan . |

OTHER PUBLICATIONS

Abstract for JP–52–85513.
Abstract for JP–53–109536.
Abstract for JP–55–16906 (A).
Abstract for JP–61–160476 (A).
Abstract for JP–1–132819 (A).
Abstract for JP–2–139416 (A).
Abstract for JP–2–221448 (A).
Abstract for JP–3–69613 (A).

*Primary Examiner*—Newton Edwards
*Attorney, Agent, or Firm*—Barnes, Kisselle, Raisch, Choate, Whittemore & Hulbert, P.C.

[57] ABSTRACT

The present invention relates to a nonwoven fabric including a fine denier filament having a plexifilamentary structure in which the disadvantages of polyolefins and of polyesters are offset each other while advantages of them are well utilized with a fine fibrillated structure comprising said filament. The filament comprises a mixture which is at least composed of polyolefin and polyester which are immiscible with each other and has a plexifilamentary structure. The filament is so highly fibrillated that the fibril has not been available yet and, in addition, the filament is with high strength and modulus and exhibits a good dyeing ability. The above-mentioned nonwoven fabric contains the filaments having a plexifilamentary structure in which a mixture of polyolefin and polyester which are immiscible with each other in a mixing ratio within a range of from 5/95 to 95/5 by weight and said filaments are entirely or partially bonded. Said nonwoven fabric is with excellent strength, moisture permeability and waterproof pressure and exhibits a dyeing ability.

5 Claims, 1 Drawing Sheet

U.S. PATENT DOCUMENTS

| | | |
|---|---|---|
| 3,902,957 | 9/1975 | Kozlowski . |
| 4,107,243 | 8/1978 | Stearns et al. . |
| 4,166,091 | 8/1979 | Beebe . |
| 4,368,295 | 1/1983 | Newton et al. . |
| 4,443,513 | 4/1984 | Meitner et al. . |
| 4,704,321 | 11/1987 | Zafiroglu . |
| 4,908,052 | 3/1990 | Largman et al. . |
| 4,966,808 | 10/1990 | Kanano . |
| 4,998,421 | 3/1991 | Zafiroglu . |
| 5,082,720 | 1/1992 | Hayes . |
| 5,108,827 | 4/1992 | Gessner . |
| 5,124,194 | 6/1992 | Kanano . |
| 5,192,468 | 3/1993 | Coates et al. . |
| 5,268,218 | 12/1993 | Zafiroglu . |
| 5,281,668 | 1/1994 | Heggs et al. . |
| 5,290,628 | 3/1994 | Lim et al. . |
| 5,294,482 | 3/1994 | Gessner . |
| 5,366,804 | 11/1994 | Dugan . |
| 5,372,885 | 12/1994 | Tabor et al. . |
| 5,389,431 | 2/1995 | Vamasaki . |

FILAMENT HAVING PLEXIFILAMENTARY STRUCTURE, NONWOVEN FABRIC COMPRISING SAID FILAMENT AND THEIR PRODUCTION

REFERENCE TO CO_PENDING APPLICATION

This is a continuation of co-pending U.S. application Ser. No. 08/791,344 filed 31 Jan. 1997, now pending, a continuation-in-part of application of U.S. patent application Ser. No. 08/577,244 filed Dec. 22, 1995, now abandoned, which is a divisional application of Ser. No. 08/341,608, filed on Feb. 27, 1995, now abandoned, which was 371 of PCT/JP94/00581 filed on Apr. 6, 1994, now World Patent No. WO 9424347 (published Oct. 27, 1994).

TECHNICAL FIELD

The present invention relates to fine denier filament having plexifilamentary structure composed of a mixture of polymers which are immiscible with each other, to nonwoven fabric comprising said filament and having a fine fibrillated structure and also to their production.

BACKGROUND OF THE INVENTION

With respect to a method of manufacturing fine denier filaments and nonwoven fabric using said filaments, it has been known that multi-component filaments of a sea-island type are subjected to a spinning followed by removing a part of the polymer components therefrom using a solvent and the resulting filaments are subjected to a bonding to afford nonwoven fabric. It has been also known to use the so-called melt-blowing method in which a molten polymer is extruded from spinning nozzles followed by drafting with a heated fluid to fibrillate. However, in a method in which a part of the polymer components of the multi-component filaments is removed using a solvent, various steps are necessary. According to a melt-blowing method, it is true to give very fine filaments but, since said melt-blowing method conducts the fibrillation at the stage of molten polymer, there are disadvantages of little drawing orientation and crystallization whereby the resulting filaments are mechanically very weak.

On the other hand, the so-called flash-spinning method has been known for preparing very fine filaments from a solution of polymers. As disclosed in U.S. Pat. No. 3,081,519, said method of flash-spinning is a method in which a solution of a polymer in a low-boiling-point solvent is extruded from spinning nozzles to evaporate the solvent instantly.

According to the flash-spinning method, the resulting multi-fibrous yarn-like filament has an internal fine structure or morphology which may be characterized as a three-dimensional integral plexus consisting of a multitude of essentially longitudinally extended interconnecting random length fibrils. The fibrils, often found as aggregates, intermittently unite and separate each other at irregular intervals called "tie points" in various places throughout the width, length and thickness of the strand to form an integral three-dimensional plexus. The filament comprising a three-dimensional network of the fibrils is referred to as a plexifilament.

However, known filaments prepared by the flash-spinning method are composed of one polymer component for any of the materials and, therefore, there is a problem that they have a disadvantage inherent to the polymer resulting in a restriction in the development of the use of the product. The art disclosed in Japanese Examined Patent Publication 41-56215 and Japanese Laid-open Unexamined Patent Application 1-97256 has the same problem too. To be more precise, filaments prepared from polyolefins by the flash-spinning method are excellent in lightness in weight but have low modulus, thereby giving to users little feeling of using or wearing while presenting unique surface smoothness. Although polyesters are polymers which are by nature suitable to be used for preparing filaments having high tenacity, the filaments prepared from polyesters by the flash-spinning method tend to be lower in tenacity although their modulus is high. Because of this, such filaments as prepared from polyesters by the flash-spinning method have not yet been put to practical use.

DISCLOSURE OF THE INVENTION

Figure 1:
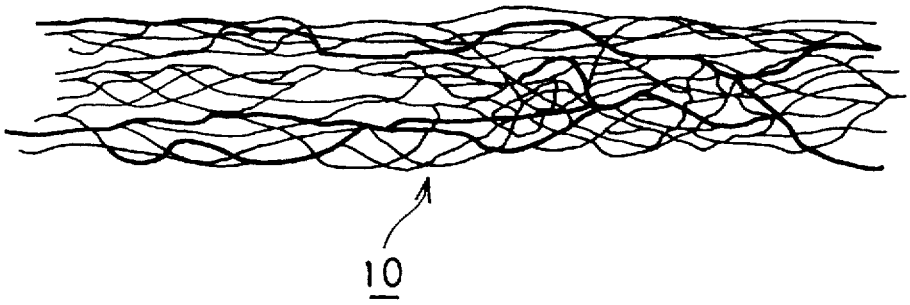
FIG. 1 illustrates an enlarged view of a filament 10 having a plexifilamentary structure according to the present invention.

The object of the present invention is to solve the above problems by offering a nonwoven fabric made of fine denier filaments having a plexifilamentary structure and a method for manufacturing the nonwoven fabric. Particularly, the fine denier filaments have been provided by offsetting the disadvantages of polyolefin and of polyester each other and best utilizing the advantages of them.

The inventors have carried out extensive studies and achieved the object of the invention to solve the above problems.

The filament in accordance with the present invention is composed of polyolefin and polyester, and has a plexifilamentary structure comprising unprecedented fibrillated filaments of extremely highly fine denier, as well as high tenacity and high modulus. Therefore, it is applicable as materials for textile fabrics, knitted fabrics, nonwoven fabrics obtained by a dry method, nonwoven fabrics obtained by a wet method, stuffing staple fibers, and the like, and, in addition, is suitable for various purposes such as clothing materials, thermal insulation materials, artificial leathers, absorbing materials used as sanitary materials, protective clothings, curtains, bed sheets, wipers, filters, house wrappings, synthetic paper, and the like. Since the filament contains polyester, it can be coloured not only by pigments but also can be suitably dyed in the after-treatment.

The nonwoven fabric having a fine fibrillated structure in accordance with the present invention contains filaments having a plexifilamentary structure, said filaments containing plexifilamentary structured polyolefin element and plexifilamentary structured polyester element which are immiscible with each other and are in a ratio within a range of from 5/95 to 95/5 by weight, said filaments further being bonded to each other. The filaments having a plexifilamentary structure are bonded each other in the entire areas of the nonwoven fabric or just partially.

Here, the terms "plexifilamentary structured polyolefin element" and/or "polyolefin element" and "plexifilamentary structured polyester element" and/or "polyester element" are used to represent the followings: namely; the state in which polyolefin and polyester, which are the components of the filament having a plexifilamentary structure, are phase-separated from each other without fusing each other as immiscible components, and are also spatially separated from each other except at the afore-mentioned tie points. Here, the "phase-separated" means the state in which one of polyolefin and polyester has higher concentration and the other has lower concentration at a certain part of the plexifilamentarily structured filament. Further, in brief, the above-said "element" can be defined as a component comprising a fibril structure.

In detail, the filament according to the present invention is a filament formed from the polymer solution containing polyolefin and polyester in one kind of solvent at high pressure and high temperature, the solution being spun from a single nozzle. When the polymer solution is extruded in an environment of atmospheric pressure and room temperature, as a result of evaporation of the solvent, which is caused by explosion at the time of spinning, the plexifilamentary structure is formed with two elements, polyolefin element and polyester element, being phase-separated and spatially separated except the tie points from each other.

According to the afore-mentioned U.S. Pat. No. 3,081,519, the plexifilamentary structure comprises only one element, whereas according to the present invention, the plexifilamentary structure comprises two elements being phase-separated and spatially separated from each other except at the tie points.

This kind of plexifilamentary structure of the present invention cannot be obtained only by melt spinning of blended polyolefin and polyester.

The method of manufacturing the nonwoven fabric having a fine fibrillated structure in accordance with the present invention comprises the steps of: preparing filaments having a plexifilamentary structure by flash spinning a mixture of polyolefin and polyester, which are immiscible with each other, within a range of from 5/95 to 95/5 by weight; forming the filaments into webs; and bonding the webs with heat and pressure using a plurality of rolls so that entire mixed plexifilaments of the filaments are adhered.

Another method of manufacturing the nonwoven fabric in accordance with the present invention comprises the steps of: preparing filaments having a plexifilamentary structure by flash spinning a mixture of polyolefin and polyester, which are immiscible with each other, within a range of from 5/95 to 95/5 by weight; forming the filaments into webs; and partially bonding the webs with heat and pressure using an embossing apparatus so that the mixed plexifilaments of the filaments are partially adhered.

As such, nonwoven fabric of a fine fibrillated structure comprising a highly fibrillated fine denier filaments can be prepared in accordance with the present invention. Among them, the nonwoven fabric in which the filaments having a plexifilamentary structure are bonded to each other in the entire area are suitable for various purposes including envelopes, packing materials, floppy sleeves, water-proof materials, labels, thermal insulation materials, synthetic paper, protective clothings as protective materials for sanitary materials, curtains, bed sheets, wipers, filters, house wrappings, and the like. In addition, the nonwoven fabric in which the filaments of the plexifilamentary structure are partially bonded is suitable for various uses such as clothings, thermal insulation materials, protective clothings as medical and sanitary materials, curtains, bed sheets, wiper, filter, house wrappings, tents, artificial leathers, and the like.

Hereunder, the filament having a plexifilamentary structure in accordance with the present invention will be further explained.

Figure 2:
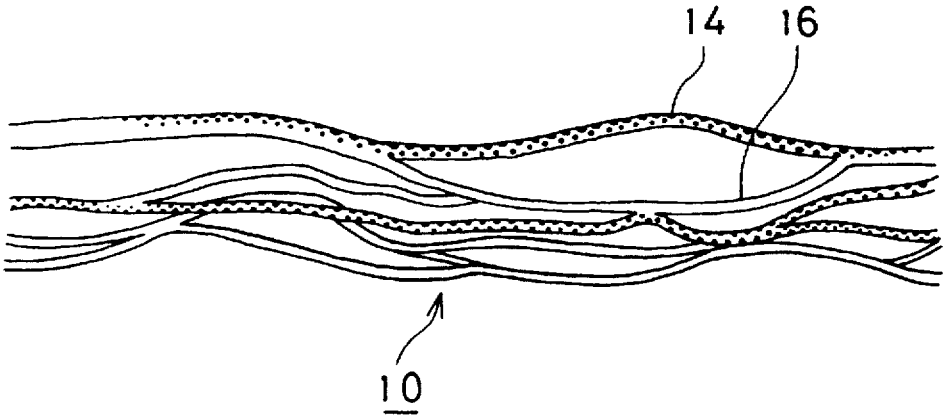
FIG. 2 schematically shows an enlarged longitudinal section of the essential part of FIG. 1.

The subject matter of the application is illustrated by the drawings, FIG. 1 and FIG. 2. FIG. 1 illustrates an enlarged view of a filament 10 having a plexifilamentary structure according to the present invention. FIG. 2 schematically shows an enlarged longitudinal section of the essential part of FIG. 1. In FIG. 2, the parts which are marked with dots represent plexifilamentary polyethylene element 14 and the parts which are not marked with dots represent plexifilamentary polyester element 16. The plexifilamentary structured polyethylene element 14 and the plexifilamentary structured polyester element 16 are mixed, but they are immiscible with each other. Therefore, they are formed together, but in a separated state from each other to form the plexifilamentary structure of the filament, as depicted in the drawings. However, in addition to the parts where the elements 14 and 16 are completely separated, there are such parts as containing both elements 14 and 16 where either one of the elements is richer than the other.

The plexifilamentary structure of the present invention means the fibril filaments corresponding to 0.01–10 μm in diameter which are formed in a three-dimensional state and in an endless manner in the longitudinal direction.

It is necessary that the components constituting the filament of the present invention are the polymer components which are immiscible with each other. As a result of the fact that they are immiscible with each other, the mixed polymer components are present independently whereby the resulting filament exhibits the fibrous characteristics inherent to each of the polymer components. It has generally been known that a mixed filament of polymers which are immiscible with each other is apt to be divided into each component when a physical force is applied. In the filament of the present invention, the polymers are immiscible with each other, and, therefore, fine denier fibril filaments of each of the polymers are dominantly constructed. The specific combination of the polymer components therefor is a combination of polyolefin and polyester.

Examples of the polyolefin which composes the polymer components constituting the filaments of the present invention are polyethylene, polypropylene, copolymer mainly comprising ethylene, copolymer mainly comprising propylene, etc.

It is preferred that the viscosity of the ethylenic polymers among the above-given polymers is 0.3–30 g/10 min in terms of a melt index value as measured by a method of ASTM-D-1238E. When the melt index value is less than 0.3 g/10 min, the viscosity of the mixed solution becomes too high whereby fine denier fibril filaments are hardly obtained. Whereas, when the melt index value is more than 30 g/10 min, the tenacity of the filament per se lowers and, at the same time, smoothness and stickiness of the filament increase whereby the handling of the filaments tends to be hard.

Examples of the polyester which is another polymer component constituting the filament of the present invention are polyethylene terephthalate, polybutylene terephthalate, etc. Further examples which are applicable are the copolymers in which the above-mentioned one is a main components containing up to 40 molar % of the copolymerizing monomers such as isophthalic acid, phthalic acid, glutaric acid, adipic acid, sulfoisophthalic acid, diethylene glycol, propylene glycol, 1,4-butanediol, 2,2-bis(4-hydroxyethoxyphenyl) propane, bisphenol A, polyalkylene glycol, etc. The applicable viscosity of the polymer in terms of a relative viscosity as measured by a 0.5% solution in a 1:1 (by weight) mixture of tetrachloroethane and phenol at 20° C. is from around 1.3–1.6 (filament grade) to 1.7 (a highly-viscous resin prepared by a solid phase polymerization). The higher the viscosity of the polymer is, the more the filament tenacity is and, therefore, the better.

It is necessary that the components which constitute the filament of the present invention comprise a mixture of the polymers which are at least composed of the components being immiscible with each other and having a melting point of not lower than 100° C. each. The reason why they should be immiscible with each other is as mentioned already while the reason why the polymer components with melting point of not lower than 100° C. are necessary is a regulation from a practical viewpoint. Thus, when the melting point is lower than 100° C., the polymer is melted even by a boiling water and is extremely restricted form the development of the use in practical side. Accordingly, it is more preferred that the melting point is 120° C. or higher. The phrase reading "at least composed of" means that the above-mentioned mixed polymer components occupy at least 50% by weight in the filaments. If it is less than 50% by weight, the characteristics of the polyolefin and of the polyester are lost and that is not preferred.

In the filament of the present invention, it is preferred that the mixing ratio (by weight) of the polyolefin to the polyester is from 5/95 to 95/5. When the mixing ratio of the polyolefin or the polyester is less than the above-mentioned range, the characteristic property of such a polymer is lost and, therefore, that is not preferred. To be more precise, when the mixing ratio of the polyolefin is less than 5% by weight, both lightness and tenacity of the filament lower while, when that of the polyester is less than 5% by weight, modulus of the filament lowers, the stiffness and the touch on use and wearing are not achieved and, in addition, the smooth feeling which is characteristic to polyolefin is not resulted. Accordingly, the more preferred range of the mixing ratio is from 15/85 to 85/15 and the most preferred one is from 25/75 to 75/25.

Now, one of the methods for the manufacture of the filament having a plexifilamentary structure in accordance with the present invention will be illustrated as hereunder. In manufacturing the filament of the present invention, the commonly known method of flash spinning may be applied. As hereunder, it will be explained in more specific manner.

First, a mixture of polyolefin and polyester is dissolved, at high temperature and high pressure, in a solvent in which both polymers are insoluble at low temperature but are soluble at high temperature and high pressure. After making it as a single bath phase, it is spun out from nozzles under a state of a phase separation whereby the above-mentioned filaments are prepared.

Examples of the solvent therefore are commonly known aromatic hydrocarbons such as benzene and toluene; aliphatic hydrocarbons such as butane, pentane and isomers as well as homologues thereof; alicyclic hydrocarbons such as cyclohexane; and unsaturated hydrocarbons. Other examples are halogenated hydrocarbons such as trichloromethane, methylene chloride, carbon tetrachloride, chloroform, 1,1-dichloro-2,2-difluoroethane, 1,2-dichloro-1,1-difluoroethane, methyl chloride, ethyl chloride, etc. Further examples are alcohols, ethers, ketones, nitriles, amides, fluorocarbons, etc. Still further examples are mixtures of the above-mentioned solvents. Taking the recent circumstances where the global environment is a big problem into consideration, the use of the solvents which might destruct an ozone layer is to be particularly avoided. Considering said environmental matter as well, we shall list up methylene chloride, 1,1-dichloro-2,2difluoroethane, 1,2-dichloro-1,1-difluoroethane, etc. as the solvents which are preferably used in conducting the present invention.

The range of the concentrations of the polymers will not be so definitely limited since it depends upon the degree of polymerization of the polymer, the type of the solvent, the pressurizing state, etc. but it is recommended to adjust to such an extent that the concentrations of the polymers and of the solvent in the spinning dope are 5–30% by weight and 95–70% by weight, respectively. When the concentration of the polymers is less than 5% by weight, it is difficult to obtain continuous filaments while, when it is more than 30% by weight, no fibrillation takes place resulting in cylindrical filaments containing foams therein whereby it is difficult to obtain the fine denier fibrillated filaments of high tenacity. When the concentration of the solvent is less than 70% by weight, the viscosity of the spinning dope becomes too high to dissolve the polymers homogeneously whereby there is a tendency that fine denier fibrillated filaments are not resulted giving the filaments with cavities while, when it is more than 95% by weight, the filaments having a plexifilamentary structure composed of the fibrillated filaments in a continuous manner are not resulted and, accordingly, that is not preferred.

It is greatly preferred for increasing the spinning pressure that, before or after preparing the spinning dope, inert gas represented by nitrogen gas or the like is added thereto and injected thereinto. It is particularly preferred to add the inert gas before raising the temperature because degradation of the polymers can be prevented and an ability of rising the temperature is improved whereby the solubility of the polymers in the solvent is accelerated to give a very fine denier filaments with a fibrillated plexifilamentary structure.

In the manufacture of the filament having a plexifilamentary structure according to the present invention, the elongation and the orientation of the filament are carried out by means of an explosive power accompanied by evaporation of the solvent and the tenacity of the filament are often decided by the fact whether said filament is well elongated and oriented. The explosive power at that time is a vapourizing power as a result of the speed at the moment. In terms of the speed, the solvent is vapourized at a time within a period of not longer than 0.1 second and, during said process, an increase in the concentration of the polymers is resulted within a short period and, at last, only the mixed polymers are precipitated. The mixed polymers which are precipitated as a result of vapourization of the solvent are cooled. For the tenacity, this cooling step is most important and, in obtaining the filaments with high tenacity, the cooling by means of a flash flow and the elongation and the orientation depending upon the cooling speed should be well carried out. In a manufacturing method according to the present invention, the polymers which are not miscible with each other are used and, therefore, the fibrillation is well promoted by said flash flow whereby very fine denier fibrillated filaments are resulted.

Since the polymers which are not miscible with each other are used in conducting the method of the present invention, the polymers are easily separated even when the polymers are dissolved in the solvent and, therefore, it is preferred to add a surface-active agent thereto. Addition of a surface-active agent is effective in stably keeping the spinning dope in an emulsified state. Usually, a surface-active agent of a nonionic type is applied. Examples of the surface-active agent are adducts of polyoxyethylene with lauryl alcohol, stearyl alcohol, oleyl alcohol, etc. and monoesters of lauric, stearic or oleic acid. The more homogeneous the mixed solution or the dope is, the more fine denier fibrillated plexifilamentary structured filaments are.

In carrying out the manufacturing method of the present invention, it is preferred that the dissolving and spinning temperature of the spinning dope is within a range of 170° to 240° C. A lowering in viscosity in the presence of a solvent is particularly significant in the case of the polyesters and, therefore, when the temperature is higher than 240° C., the filaments may be coloured or the degradation is accelerated whereby the filaments with high tenacity may not be obtained and, therefore, that is not preferred. When the temperature is lower than 170° C., very fine denier fibrillated filaments are not resulted but cylindrical filaments having cavities are formed and, therefore, that is not preferred.

The retention time of the dissolved state of the spinning dope in carrying out the manufacturing method of the present invention will not be definitely given since it depends upon the above-mentioned dissolving and spinning temperatures. Thus, when the temperature is high, it is necessary that the retention time of dissolution is kept as short as possible while, when the temperature is relatively low, the retention time for dissolution may be long. If mentioned daringly, it is preferred to be from 5 minutes to 90 minutes. When the retention time for dissolution of the mixture for spinning is longer than 90 minutes, colouring or heat degradation of the polyester may take place whereby the tenacity of the filaments may lower while, when that time is shorter than 5 minutes, dissolution of the polymers is insufficient giving a problem of choking of the filter or a problem on manufacturing the uniform filaments and, therefore, that is not recommended.

The pressure for spinning the dope in which the polymers are dissolved is not generally regulated because it depends upon the amount of the solvent, the concentration of the polymers and the amount of the inert gas added but, usually, it is preferred to be not lower than 60 kg/cm$^2$. When the pressure is lower than 60 kg/cm$^2$, the explosive power at the flash spinning is low whereby the orientation of the filaments is low and it is not possible to afford the filaments with high tenacity. In addition, the extrusion becomes uneven and there is a problem that the spinning of filaments with a stable and highly fibrillated state is not prepared. There is no particular restriction for the upper limit of the pressure but, in view of prevention of a decrease in viscosity of the polymer, it is preferably 180 kg/cm$^2$.

In conducting a flash spinning, the spinning dope is spun under a self-generated pressure or via a pressure letdown chamber. With respect to the nozzles for the spinning, commonly known ones may be used.

In the polymers or spinning dope, the agents which are commonly used for filaments such as anti-glassy agents, light-stable agents, heat-stable agents, pigments, filament opening agents, weather-stable agents, ultraviolet absorbent agents, heat-saving agents, stabilizers, etc. may be added within such an extent that they do not deteriorate the effect of the present invention.

Then the nonwoven fabric having a fine fibrillated structure in which the filaments in the plexifilamentary structure are bonded in the entire area and a method of manufacturing it will be illustrated in detail as hereunder.

Said nonwoven fabric is prepared using the filaments having the above-mentioned plexifilamentary structure.

The phrase reading nonwoven fabric having a dense structure used here means the nonwoven fabric in which the apparent density is not less than 0.2 g/cm$^3$ and the above-mentioned very fine denier plexifilamentary structure is densely bonded.

The filaments which constitute the nonwoven fabric of the present invention are not miscible with each other and, therefore, the fibrillated filaments of very fine denier single polymer are mainly formed. The finer the filaments, the more densely constructed nonwoven fabric is resulted. Thus, as compared with the conventional nonwoven fabric, the product of the present invention exhibits a higher ability as a bacteria barrier which does not pass the bacteria of smaller sizes.

It is necessary that the nonwoven fabric of the present invention is in such a state that the filaments having a plexifilamentary structure are bonded each other in the entire area. This means that the filaments in a very fine denier fibrillated plexifilamentary structure are densely bonded at the bonded areas and the bonding is not in spots. In other words, the bonding takes place at the bonded areas of very fine denier fibrillated filaments and, therefore, the nonwoven fabric with very dense structure is resulted and the resulting nonwoven fabric is with excellent strength, ability as a bacteria barrier, waterproof pressure and moisture permeability.

Accordingly, it is preferred that the nonwoven fabric of he present invention exhibits a strength of not less than 20 kg/5 cm calculated in terms of the weight of 100 g/m$^2$. When the strength is less than 20 kg/5 cm, it is not possible to use for various areas and the use of the nonwoven fabric will be extremely restricted.

It is preferred that the moisture permeability which shows the property of dispersing the humidity is not less than 100 g/m$^2$/hr. When the moisture permeability is less than 100 g/m$^2$/hr, the humidity is hardly dispersed and, accordingly, when it is used as a clothing or a house wrapping, humidity is filled in it whereupon droplets of water are formed, uncomfortable feel is resulted or fungi are produced to afford a nonhygienic state. Accordingly, the higher the moisture permeability, the better.

Preferred waterproof pressure is 50 cm or higher. The waterproof pressure is a parameter of the degree how hardly the liquid such as water is permeated. When it is less than 50 cm, liquid such as water permeates through said fabric together with bacteria whereupon the bacteria barrier ability is deteriorated. Accordingly, the product cannot be used as a clothing for protecting sanitary materials. Therefore, the higher the value of the water-proof pressure, the better.

A manufacturing method of the above-mentioned nonwoven fabric will be given as hereunder.

In the manufacture of the nonwoven fabric according to the present invention, the filaments having a plexifilamentary structure which constitute the nonwoven fabric should be manufactured at first and, in manufacturing said filaments having a plexifilamentary structure, the method of flash spinning as mentioned above is applied.

When the mixed solution or the dope for spinning is spun out from the nozzles, the flash fluid and the sedimented filaments collide with the rotating plate and, after the filaments in a network structure are subjected to a vibration like twill, a filament opening takes place. The process of the formation of the filaments with a plexifilamentary structure is as mentioned already. With respect to a method for the filament opening, there are two means. One is a frictional electrification by the rotating plate and another is a corona discharge thereafter and any of or both of those means may be applied.

The filaments with a plexifilamentary structure which are opened as such are accumulated on a conveyer and the resulting filament web is subjected to a bonding by application of heat and pressure by means of a group of rolls. The conditions for the bonding are as follows. Thus the temperature is made not lower than "(melting point of the polymer having the lowest melting point among the polymers comprising the filaments)–(40° C.)" and not higher than said melting point while the nip pressure of roll axis direction is made from 0.5 kg/cm to 20 kg/cm. The definite conditions are suitably chosen at last. The bonding with pressure by means of a group of rolls at room temperature and further bonding with pressure under the above-mentioned condition are more preferred since a strong bonding is resulted at the bonded area between the filament and another.

When the temperature of lower than (melting point of the polymer)–(40° C.)" is applied in the final stage, the adhesion or the bonding throughout the filaments decreases whereby the tenacity of the nonwoven fabric is lowered while, when the bonding with heat and pressure is applied at the temperature of higher than the melting point, the filaments are melted and the effect of preparing a fine denier fibrillated filaments is deteriorated. Accordingly, those are not preferred.

With respect to the nip pressure of roll axis direction, an adhesion throughout the filaments is deteriorated and the tenacity of the nonwoven fabric lowers when it is less than 0.5 kg/cm while, when it is more than 20 kg/cm, there is a tendency that the filament layer becomes filmy and, therefore, those are not preferred.

Steel rolls, rubber rolls and resin rolls are jointly used as to the above-mentioned group of rolls. When steel rolls are applied, coating with fluoroethylene resin, rubber, etc. is preferred because a formation of unusual lustre on the resulting nonwoven fabric can be prevented. Two to thirty rolls may be used. The use of a device called a calender roll apparatus as a common device for such a group of rolls is most preferred.

In the nonwoven fabric of the present invention, adjustment of the weight can be carried out by changing the above-mentioned vibration-like twill and conveyer speed. A big change in the weight is possible by laminating the formed web or nonwoven fabric.

Then a nonwoven fabric having a fine fibrillated structure in which the filaments having a plexifilamentary structure are bonded each other to form many heat bonded areas with a certain distance kept one another and its manufacturing method will be illustrated in detail.

Such a nonwoven fabric can be manufactured using the above-mentioned filaments having a plexifilamentary structure as well.

It is necessary that the nonwoven fabric in that case is in such a state that the filaments having a plexifilamentary structure is partially bonded. This means that the very fine denier filaments having a fibrillated network structure are partially bonded in certain areas in a state of a mixed spinning and also by a polymer which is a low melting component. Thus they are not bonded in its entirety. In other words, very fine denier fibrillated filaments are partially bonded by the polymer which is a low-melting component whereby the shape of the nonwoven fabric is maintained. The filaments where the partial bonding does not take place are constructed by a very fine denier filaments having a fibrillated plexifilamentary structure. Accordingly, in spite of a dense structure, the resulting nonwoven fabric is soft and is with excellent tenacity and moisture permeability. In addition, because of such a dense structure, it naturally exhibits a property as a bacteria barrier.

Such a partially bonded state can be expressed by the ratio of the bonded area to the entire area of the obtained nonwoven fabric. Said ratio is measured as follows. Thus, a picture of the small piece of the nonwoven fabric is taken by a scanning electron microscope and the average value of the ten measurements of the ratio of the sum of the bonded area to the area of the minimum repeating unit. The preferred ratio of the bonded area to the entire area is not more than 50%. When the ratio is more than 50%, the bonded area becomes too much whereby the freedom of the nonfixed filaments in the nonwoven fabric is restricted and there is a tendency that the nonwoven fabric becomes hard and is without softness. On the other hand, when said ratio is too small, the shape of the nonwoven fabric is deteriorated. Accordingly, it is preferred to be not less than 4% from a practical viewpoint. Taking the above into consideration, the most preferred range is from 5% to 30%.

The state of such a partial bonding can be expressed by the density of the bonded area too. The density of the bonded area is calculated as follows. Thus, a picture of a small piece of the nonwoven fabric is taken by a scanning electron microscope, the ratio of the sum of the numbers of the bonded area to the area of the minimum repeating unit is calculated in terms of per $cm^2$, such a measurement is conducted for ten times independently and an average value is calculated therefrom. The preferred density of the bonded area is from $15/cm^2$ to $120/cm^2$. When it is less than $15/cm^2$, the shape of the nonwoven fabric is no good and, in addition, there is a decrease in the abrasion resistance of the nonwoven fabric resulting in a problem of fluffiness. Accordingly, the higher the density of the bonded area, the less the practical problems and, therefore, the better. However, when said density is too high, handling of the nonwoven fabric may be hard and without softness. Accordingly, the preferred ratio is not more than $120/cm^2$. In view of the above, the more preferred range is from 20 to $100/cm^2$ and the most preferred one is 30 to $90/cm^2$.

It is far preferred that both of the ratio of the bonded area to the entire area and the density of the bonded area are within the above-mentioned ranges.

The shape of such bonded areas may be any of circular, ellipsoidal, diamond-shaped, triangular, T-shaped, I-shaped, parallel-crossed and lattice-shaped.

The preferred property of the nonwoven fabric is that the strength calculated per 100 $g/m^2$ is not less than 5 kg/5 cm. This is because, when the strength is less than 5 kg/5 cm, there may be a problem on actual use and the use of the nonwoven fabric is quite limited.

Preferred softness at compression is not more than 200 g. The softness at compression stands for the softness of the nonwoven fabric and when its value is smaller, the product is softer. Said softness at compression is measured as follows. Thus, five test pieces of the nonwoven fabric having a width of 50 mm to the direction of the apparatus (longitudinal direction) and a length of 100 mm to the direction which is rectangular thereto are prepared, each of them is laterally curved to form a hollow cylinder, its both ends are adhered, the resulting sample is compressed to its axial direction at the speed of 50 mm/minute using a Tensilon UTM-4-1-100 (Toyo Baldwin), the stress at its maximum load is measured, the average value thereof is divided by a weight of the nonwoven fabric and the value calculated per 100 $g/m^2$ is defined as a softness at compression. The softness at compression of the nonwoven fabric with more than 200 g is not preferred because of a decrease in the softness and an appearance of a hardness.

Accordingly, it is more preferably not more than 160 g or, most preferably, not more than 120 g.

The preferred moisture permeability is not less than 100 g/m$^2$/hr. The moisture permeability shows an ability of dispersing the humidity and, when the value is higher, the property is better. When the moisture permeability is less than 100 g/m$^2$/hr, the humidity is hardly dispersed and, therefore, when it is used as a clothing or a house wrapping, humidity is filled therein resulting in a condensation of water droplets whereby unpleasant feel is accompanied or the nonhygienic state is resulted because of the generation of fungi. Accordingly, the higher the moisture permeability, the better.

The weight of the nonwoven fabric may be as thick as 500 g/m$^2$ and, usually, it is from 20 to 200 g/m$^2$.

A method of manufacturing the nonwoven fabric will be given as hereunder.

For the manufacture of the nonwoven fabric, the filaments having a plexifilamentary structure which constitutes the nonwoven fabric is to be manufactured at first. In the manufacture of such filaments having a network structure, the above-mentioned method of flash spinning is applied.

When the dope for spinning is spun out from the nozzles, the flash flow and the sedimented filaments collide with the rotating plate, the filaments having a plexifilamentary structure is vibrated like twill and the filament opening takes place. The process of formation of the filaments having a plexifilamentary structure is the same as given above. With respect to a method of the filament opening, there are two means—a frictional electrification using a rotating plate and a corona discharge thereafter—any of them or both may be applied.

The filaments having a plexifilamentary structure which are open as such are accumulated on a conveyer and the resulting filament web is partially subjected to a bonding with heat and pressure using an embossing roll apparatus. Examples of the embossing roll apparatus are a thermal embossing apparatus and a pin-sonic processing apparatus by means of ultrasonic wave.

The conditions for bonding with heat and pressure using a thermal embossing apparatus are as follows. Thus, the temperature is not lower than "(melting point)–(40° C.)" and is not higher than the melting point of the polymer having the lowest melting point among the polymers constituting the filaments. The nip pressure of roll axis direction is chosen from a range of 0.5 to 50 kg/cm. Incidentally, the processing may be carried out under the nip pressure condition within the above range with a clearance of 0.02–0.2 mm. The clearance is taken for preventing a filmation due to a complete fusion of the bonding area and that may be suitably conducted depending upon the use. Further, it is preferred to conduct an embossing under the above-mentioned conditions after a preliminary bonding with heat and pressure using rolls at room temperature because a disorder in the fibrillated filament web is not generated. When the bonding with heat and pressure is carried out at the temperature of higher than the melting point of the polymer at the embossing step, the filaments are sometimes melted whereby the web is wound round the roller whereby no sheet is produced. Further, there is an unpreferred tendency that the very fine denier filaments with a plexifilamentary structure are fused whereby the effect of the very fine denier fibrillated filament is deteriorated. On the other hand, the application of the temperature of lower than "(melting point of the polymer)–(40° C.)" at the final stage is not preferred since the bonding among the filaments lowers whereby the strength of the nonwoven fabric lowers.

With respect to the nip pressure of roll axis direction, the pressure of lower than 0.5 kg/cm is not preferred because the bonding at the bonding areas among the filaments lowers whereby the strength of the nonwoven fabric lowers. On the other hand, the pressure of higher than 50 kg/cm is not preferred as well because the bonding area tends to become filmy and, if things go on further, the nonwoven fabric with holes is resulted.

The conditions for bonding with heat pressure when a pin-sonic processing apparatus is used are, for example, that the filaments are partially bonded by means of an oscillation using an ultrasonic wave of about 20 KHz so that the state of the nonwoven fabric is maintained. Degree of the heat bonding can be suitably selected by changing the amplitude of the ultrasonic wave. When said method of heat bonding by ultrasonic waves is applied, the areas other than the bonding area are rarely affected by heat at the bonding step of the web with high heat bonding ability and, accordingly, the nonwoven fabric as a whole can be held in such a state that the thermal shrinkage properties can be still maintained. Accordingly, when the nonwoven fabric with a high thermal shrinkage property is manufactured, the effect can be more effectively achieved.

The embossing shape of those embossing apparatuses are usually formed of an engraving roll having a projected pattern and a flat roll. The projected pattern can be constructed by regulating the above-mentioned ratio of the bonding area and the density of the bonding area. The terminal shape of projected area of the engraved roll may be any of circular, ellipsoidal, diamond-shaped, triangular, T-shaped, I-shaped, parallel-crossed or lattice-shaped.

Incidentally, other embossing may be conducted under the above-mentioned or different conditions before or after the above-mentioned embossing processing or a calender processing may be conducted together provided that they are not out of the coverage of the present invention.

(EXPLANATIONS OF THE EXAMPLES)

The present invention will now be further illustrated by way of the following examples. Measurements and evaluations of various properties in the following examples are carried out by the following methods.

Melting Point of the Polymer

A differential scanning calorimeter (type DSC-2, Parkin Elmer) was used and the temperature giving a polar value of the melting absorption curve measured at the rising rate of 20° C./minute was established as a melting point.

Fineness of the Filament

Fineness based upon a corrected weight was measured in accordance with JIS L-1090.

Tenacity and Elongation of the Filament

Tensilon (type UTM-4-1-100; manufactured by Toyo Baldwin) was used. A sample of 10 cm length was twisted to an extent of 20 times/5 cm at the gauge length of 5 cm and the strength and the elongation were measured at a tensile speed of 5 cm/minute. The measured strength was divided by the above-mentioned fineness to give a strength of the filament. In those operations, the measurements were conducted twenty times and the average value thereof was given.

Modulus of the Filament

The initial tensile resistance (g/d) was measured in accordance with JIS L-1013 7.10 (Measurement of Initial Tensil Resistance) in the measurements of the above strength and elongation of the filament and was established as the modules value.

Specific Surface Area

The specific surface area ($m^2/g$) of the filament was measured by a BET nitrogen absorption method using Belsorp 28 of Nippon Bel KK.

Dyeing Ability of the Filament

The filament was subjected to the following dispersed dyeing or the cationic dyeing, then subjected to the reduced dyeing, washed with water, dried and the dyeing ability of the filament was evaluated in accordance with the following standards:

⊙: very good; ○: good; Δ: relatively good; X: no good (Dispersed Dyeing) Blue E-FBL (a disperse dye manufactured by Sumitomo Chemical) (1% owf), 1 g/liter of a dispersing agent (Disper-TL; manufactured by Meisei Kagaku) and 0.1 g/liter of formic acid (as a complement agent) were prepared and the filament was subjected to a boil dyeing for 60 minutes with a volume ratio of 1:50.

(Cationic Dyeing) Astrazon Blue FFR (a cationic dye manufactured by Bayer) (1% owf), 0.5 g/liter of a mixed dyeing agent (Migregal WA-10; manufactured by Senka) and 10% owf of sodium sulfate (as a complement agent) were prepared and the filament was subjected to a boil dyeing for 60 minutes with a volume ratio of 1:50.

(Reduced Dyeing) Sanmole RL-100 (a refinement agent manufactured by Nikka Kagaku KK) (1 g/liter), 2 g/liter of hydrosulfite and 1 g/liter of sodium hydroxide were prepared and the filament was treated therewith at 80° C. for 20 minutes with a volume ratio of 1:50.

KS Strength and Tensile Elongation of the Nonwoven Fabric

Tensilon (Type UTM-4-1-100; manufactured by Toyo Baldwin) was used. In accordance with a strip method mentioned in JIS L-1096, ten test pieces with a width of 5 cm and a length of 20 cm each were prepared and the measurement was conducted at a gauge length of 10 cm and tensile speed of 10 cm/minute. The maximum tensile strength for each test piece at that time was averaged and calculated in terms of 100 $g/m^2$ to establish the KS strength. Then the maximum elongations were averaged and the average value was established as the tensile elongation of the nonwoven fabric.

Apparent Density of the Nonwoven Fabric

Five test pieces with a width of 10 cm and a length of 10 cm each were prepared, weight of each test piece was measured, then a load of 4.5 $g/cm^2$ was applied using a thickness measuring device (manufactured by Daiei Kagaku Seiki Seisakusho), the thickness after allowing to stand for ten seconds was measured, the apparent density was calculated by the following formula and the average value was established as the apparent density of the nonwoven fabric.

Apparent Density ($g/cm^3$)=Weight ($g/m^2$)/Thickness (mm)/1000

Moisture Permeability of the Nonwoven Fabric

In accordance with the regulation of JIS-L 1099-A-1, the moisture permeability ($g/m^2/hr$) was measured under the conditions of 40° C. temperature and 90% humidity.

Dyeing Ability of the Nonwoven Fabric

The same operation and also evaluation were made by the same manner as those in the case of the filament.

Hereunder, examples for the filaments will be given.

EXAMPLE 1

An autoclave of 500 cc was filled up with 20 g of polyethylene of high density with a melting point of 132° C., a density of 0.96 $g/cm^3$ and a melt index of 0.8 g/10 min, 30 g of polyethylene terephthalate with a melting point of 256° C. and a relative viscosity of 1.6 and methylene chloride (a solvent). Further, each 0.2% by weight (to the above mixed polymer) of polyoxyethylene (POE) (3 moles) lauryl ether and isotridecyl stearate were added thereto as the surface-active agents. Then the autoclave was closed, nitrogen was introduced into the autoclave until the pressure became 40 $kg/cm^2$ and the stirring was initiated at a suitable speed together with heating up. Concentrations of each of the components in the solution were 20% by weight and 80% by weight for the polymers and the solvent, respectively.

The time required for the temperature rise from 100° C. to 220° C. was 25 minutes. When the temperature became 220° C., the solution was stirred for ten minutes to give a homogeneous solution. The gauge pressure at that time was 110 $kg/cm^2$. Then the valve was immediately released in such a state that a continuously introducing device of compressed nitrogen gas was applied so that the pressure in the autoclave was kept at 110 $kg/cm^2$ whereby the solution was spun out into air from the nozzles (hole diameter: 0.75 mm; L(length)/D (diameter): 1) equipped with a pressure letdown chamber. The pressure in the pressure letdown chamber was 92 $kg/cm^2$.

The resulting filaments were with very good state of fibrillation. No colouration of the filaments was noted and both strength and modulus were high. The filaments were dyed with a disperse dye whereupon it was confirmed that they were clearly dyed. Properties of the filaments were as follows:

Tensile Strength: 4.85 g/d

Elongation: 64%

Modulus: 16.7 g/d

Specific surface area: 31 $m^2/g$

EXAMPLE 2

The same autoclave as in Example 1 was used and 20 g of polypropylene with a melting point of 162° C., density of 0.910 $g/cm^3$ and a melt flow rate of 4 g/10 min, 30 g of polyethylene terephthalate with a melting point of 256° C. and a relative viscosity of 1.7 and methylene chloride (a solvent) were filled in this autoclave.

Then each 0.2% by weight (to the mixed polymer) of POE (3 moles) lauryl ether and isooctyl laurate were added thereto as the surface-active agents. The autoclave was closed, nitrogen was introduced thereinto until the pressure became 50 $kg/cm^2$ and a stirring with a suitable speed was initiated together with a heating. The concentrations of the mixed polymer and the solvent in the solution were 20% by weight and 80% by weight, respectively. The time required from the temperature rose from 100 to 200° C. was 30 minutes. When the temperature became 200° C., stirring was conducted for ten minutes to give a homogeneous solution. The gauge pressure at that time was 105 kg/cm$^2$ Then the valve was released immediately in such a state that nitrogen gas was introduced from a continuous introducing device of pressurized nitrogen to keep the inner pressure of the autoclave at 105 kg/cm$^2$ and the solution was spun into air from the nozzles of 0.75 mm diameter with a L/D ratio of 1 equipped with a pressure letdown chamber. The pressure in the pressure letdown chamber was 85 kg/cm$^2$.

The resulting filaments were with a good fibrillated state without colouring and both filament strength and modulus were high. It was also confirmed that the filament was clearly dyed when dyed with a disperse dye. Properties of the filament were as follows:

Tensile Strength: 3.47 g/d

Elongation: 50%

Modulus: 18.6 g/d

Specific surface area: 29 m$^2$/g

EXAMPLE 3

The same operations as in Example 2 were conducted with an exception that polyethylene terephthalate copolymerized with 5 molar % of sulfoisophthalic acid (melting point: 247° C.; relative viscosity: 1.3) was used and that the dissolving and the spinning temperatures were made 200° C. to manufacture the filaments. The pressure during the dissolution was 105 kg/cm$^2$ and the pressure of the pressure letdown chamber was 86 kg/cm$^2$.

The resulting filaments were with a good fibrillated state without colouring and both filament strength and modulus were high. It was also confirmed that, when the filaments were dyed with a cationic dye, only the polyester component was clearly dyed. Properties of the filaments were as follows:

Tensile Strength: 4.53 g/d

Elongation: 69%

Modulus: 14.1 g/d

Specific surface area: 38 m$^2$/g

EXAMPLES 4–8 AND COMPARATIVE EXAMPLES 1–2

Polyethylene of high density (melting point: 132° C.; density: 0.96 g/cm$^3$; melt index value: 0.6 g/10 min) and polyethylene terephthalate (melting point: 256° C.; relative viscosity: 1.4) in various mixing ratios and 200 g of methylene chloride (a solvent) were filled in the same autoclave as in Example 1. Each 0.2% by weight (to the above mixed polymer) of POE (3 moles) lauryl ether and isooctyl laurate were added as the surface-active agents thereto. The autoclave was closed, nitrogen was introduced thereinto until 50 kg/cm$^2$ and the stirring with a suitable speed was initiated together with a heating.

Concentrations of each of the components are as given in Table 1. The time required for rising the temperature from 100° C. to 200° C. was 35 minutes. When the temperature became 200° C., stirring was continued for ten minutes to give a homogeneous solution. The gauge pressure at that time was about 110 kg/cm$^2$. Then the valve was immediately released in such a state that nitrogen was introduced thereinto from a continuous introducing apparatus of pressurized nitrogen to keep the inner pressure of the autoclave at 110 kg/cm$^2$ and the solution was spun into air from the nozzles (diameter: 0.75 mm; L/D=1) equipped with a pressure letdown chamber.

The results are given in Table 1.

TABLE 1

| | Mixing Ratio of Polymers (PET/PE) | Pressure at Spinning Stage (kg/cm$^2$) | Tensile Strength (g/d) | Elongation (%) | Modulus (g/d) | Specific Surface Area (m$^2$/g) | Dyeing Ability of Filament |
|---|---|---|---|---|---|---|---|
| Comparative Example 1 | 0/100 | 90 | 4.08 | 60 | 10.1 | 17 | x |
| Example 4 | 5/95 | 91 | 4.45 | 59 | 12.5 | 28 | Δ |
| Example 5 | 15/85 | 91 | 4.68 | 58 | 13.5 | 36 | ○ |
| Example 6 | 50/50 | 92 | 5.28 | 51 | 14.6 | 43 | ○ |
| Example 7 | 80/15 | 91 | 3.56 | 52 | 13.2 | 34 | ◎ |
| Example 8 | 95/5 | 92 | 2.26 | 50 | 8.3 | 24 | ◎ |
| Comparative Example 2 | 100/0 | 91 | 0.85 | 46 | 4.8 | 18 | ◎ |

PET: polyethylene terephthalate
PE: polyethylene of high density

It is clear from Table 1 that, in the Examples of the present invention, there was a tendency that the more the mixing ratio of the polyester is, the better the dyeing ability by a disperse dye is and the resulting filaments were with very good fibrillated state, no colouring and both filament strength and modulus were high.

In Comparative Example 1, the resulting filaments were with good fibrillated state and both filament strength and modulus were relatively high although, since no polyester was contained at all, the dyeing by a disperse dye was not good. In comparative Example 2, the dyeing with a disperse dye was good because it contained no polyethylene at all although the fibrillated state was not so good and, in addition, both filament strength and modulus were low.

EXAMPLE 9

Filaments were manufactured under the same conditions as in Example 6 with an exception that polybutylene terephthalate (melting point: 228° C.; relative viscosity: 1.7) was used and the dissolving and spinning temperatures were made 200° C. The pressure at the dissolving stage was 112 kg/cm$^2$ and the pressure in the pressure letdown chamber was 93 kg/cm$^2$.

The resulting filaments were with a very good fibrillated state without colouring and both filament strength and modulus were high. It was also confirmed that the filaments were well dyed with a disperse dye. Properties of the filaments were as follows:

Tensile Strength: 4.62 g/d

Elongation: 63%

Modulus: 13.6 g/d

Specific surface area: 38 $m^2/g$

EXAMPLE 10

A ten-liter autoclave was used and 600 g of polyethylene of high density (melting point: 132° C.; density: 0.96 $g/cm^3$; melt index value: 0.8 g/10 mini), 900 g of polyethylene terephthalate (melting point: 256° C.; relative viscosity: 1.7) and methylene chloride (a solvent) were filled therein. Each 0.2% by weight (to the above-mentioned mixed polymers) of POE (3 moles) lauryl ether and isotridecyl stearate were added. The autoclave was closed, nitrogen was introduced thereinto until the pressure became 20 $kg/cm^2$ and a stirring with a suitable speed was initiated together with a heating. Concentrations of the polymers and the solvent in the solution were 20% by weight and 80% by weight, respectively.

The time required for rising the temperature from 100° C. to 220° C. was 40 minutes. Stirring was continued for ten minutes when the temperature became 220° C. to give a homogeneous solution. The gauge pressure at that time was 109 $kg/cm^2$. Then three valves were released in such a state that a continuously introducing device of compressed nitrogen gas was applied so that the pressure in the autoclave was kept at 110 $kg/cm^2$ whereupon the solution was spun out from three nozzles (diameter: 0.75 mm; L/D=1) equipped with a pressure letdown chamber. This was collided with a rotating plate, then opened and accumulated on a moving conveyer net to give webs. The pressure in the pressure letdown chamber was 92 $kg/cm^2$.

Then the webs were layered and passed through a clearance calender machine of an oil pressure type having three pairs of rollers to give nonwoven fabric of 50 $g/m^2$ weight. All of the surfaces of the upper rollers for this calender machine were made of urethane rubber while the lower rollers were heating rollers wherein the steel surface was coated with fluorine resin. The temperatures and the nip pressures of roll axis direction from the first to the third rollers were made 60°, 120° and 125° C. and 0.3, 0.8 and 1.5 kg/cm, respectively.

The resulting nonwoven fabric was with a very good state of fibrillation of the filaments without colouring. In addition, the filaments were bonded throughout the entire surfaces and, therefore, the strength of the nonwoven fabric was high and both moisture permeability and waterproof pressure were high as well. It was also confirmed that the nonwoven fabric was able to be dyed clearly when dyed with a disperse dye. Properties of this nonwoven fabric were as follows.

Specific surface area: 31 $m^2/g$

KS Strength of the nonwoven fabric (MD/CD):

38.4/39.8 kg/5 cm (MD: machine direction; CD (cross direction)

Elongation of the nonwoven fabric (MD/CD): 18/26%

Apparent density: 0.40 $g/cm^3$

Moisture permeability: 280 $g/m^2/hr$

Waterproof pressure: 180 $cmH_2O$

Dyeing ability: ⊙

EXAMPLE 11

The same apparatus as in Example 10 was used and 400 g of polypropylene (melting point: 162° C.; density: 0.910 $g/cm^3$; melt flow rate value: 4 g/10 min), 1,100 g of polyethylene terephthalate (melting point: 256° C.; relative viscosity: 1.6) and methylene chloride (a solvent) were filled in the autoclave. Each 0.2% by weight (to the mixed polymers) of POE (3 moles) lauryl ether and isooctyl laurate were added to the above mixed polymers as the surface-active agents. The autoclave was closed, then nitrogen was introduced into the autoclave until the pressure became 40 $kg/cm^2$ and a stirring at a suitable speed was initiated together with a heating. The concentrations of the mixed polymers and the solvent in the solution were 20% by weight and 80% by weight, respectively.

The time required for rising the temperature from 100° C. to 200° C. was 30 minutes and, when the temperature became 200° C., a stirring was conducted for ten minutes to give a homogeneous solution. The gauge pressure at that time was 118 $kg/cm^2$. Then three valves were immediately released keeping the pressure of the autoclave at 120 $kg/cm^2$ by means of a continuous introducing apparatus of compressed nitrogen gas so that the solution was spun out from three nozzles (hole diameter: 0.75 mm; L/D=1) equipped with a pressure letdown chamber. This was collided with a rotating plate, opened and accumulated on a moving conveyer net to prepare webs. The pressure of the pressure letdown chamber was 99 $kg/cm^2$. Then the webs were laminated and the same operations as in Example 10 were carried out with an exception that the temperatures of the first to the third rollers were made 60°, 150° and 155° C., respectively to manufacture nonwoven fabric of a weight of 100 $g/m^2$.

The resulting nonwoven fabric was with a very good state of fibrillation of the filaments without colouring and, in addition, the filaments were bonded throughout the entire surfaces. Accordingly, the strength of the nonwoven fabric was high and both moisture permeability and waterproof pressure were high as well. It was also confirmed that the nonwoven fabric was able to be dyed clearly when dyed with a disperse dye. The properties of the resulting nonwoven fabric were as follows.

Specific surface area: 29 $m^2/g$

KS Strength of the nonwoven fabric (MD/CD):

32.3/33.6 kg/5 cm

Elongation of the nonwoven fabric (MD/CD): 22/29%

Apparent density: 0.47 $g/cm^3$

Moisture permeability: 263 $g/m^2/hr$

Waterproof pressure: 159 $cmH_2O$

Dyeing ability: ⊙

EXAMPLE 12

Nonwoven fabric was manufactured by the same conditions as in Example 11 with an exception that polyethylene terephthalate which was copolymerized with 5 molar % of sulfoisophthalic acid (melting point: 247° C.; relative viscosity: 1.3) was used and the dissolving and the spinning temperatures were made 200° C. The pressure at the dissolving state was 119 $kg/cm^2$ and the pressure of the pressure letdown chamber was 100 $kg/cm^2$.

The resulting nonwoven fabric was with a very good state of fibrillation of the filaments without colouring. In addition, the filaments were bonded throughout the entire surfaces. Accordingly, the strength of the nonwoven fabric was high and both moisture permeability and waterproof pressure were high as well. It was also confirmed that the nonwoven fabric was able to be clearly dyed with a cationic dye. The properties of the nonwoven fabric were as follows.

Specific surface area: 28 $m^2/g$

KS Strength of the nonwoven fabric (MD/CD): 29.2/30.1 kg/5 cm

Elongation of the nonwoven fabric (MD/CD): 17/25%

Apparent density: 0.39 $g/cm^3$

Moisture permeability: 278 $g/m^2/hr$

Waterproof pressure: 172 $cmH_2O$

Dyeing ability: ⊙

EXAMPLE 13–17 AND COMPARATIVE EXAMPLES 3–4

The apparatus of Example 10 was used and polyethylene with high density (melting point: 132° C.; density: 0.96 $g/cm^3$; melt index value: 0.6 g/10 min) and polyethylene terephthalate (melting point: 256° C.; relative viscosity: 1.4) in varying ratio were filled in the autoclave together with 6,200 g (kept constant) of methylene chloride as a solvent. Each 0.2% by weight (to the above-mentioned mixed polymers) of POE (3 moles) lauryl ether and isooctyl laurate were added and the autoclave was closed. Then nitrogen was introduced into the autoclave to make the inner pressure 40 $kg/cm^2$ and a stirring at a suitable speed was initiated together with a heating.

Concentrations of each of the components in the solution were as given in Table 2. The time required for rising the temperature from 100° C. to 200° C. was 35 minutes and, when the temperature became 200° C., a stirring was continued for ten minutes to give a homogeneous solution. The gauge pressure at that time was about 110 $kg/cm^2$. Then three valves were immediately released keeping the pressure in the autoclave at 110 $kg/cm^2$ by an introduction of nitrogen gas to conduct a spinning and, by the same manner as in Example 10, webs were formed and nonwoven fabric was obtained.

The results are given in Table 2.

therefore, the strength of the nonwoven fabric was high and both moisture permeability and waterproof pressure were high as well.

In Comparative Example 3, the resulting nonwoven fabric was with a good state of fibrillation and the strength of the nonwoven fabric was relatively high but the dyeing ability was no good since no polyester was contained therein at all.

In Comparative Example 4, the resulting nonwoven fabric exhibited good dyeing ability with a disperse dye since it contained no polyethylene at all but the fibrillated state was not so good and, in addition, all of the strength of the nonwoven fabric, moisture permeability and waterproof pressure were low.

EXAMPLE 18

The same conditions as in Example 15 were applied for the manufacture of the nonwoven fabric with an exception that polybutylene terephthalate (melting point: 228° C.; relative viscosity: 1.7) was used and the dissolving and the spinning temperatures were made 200° C. The pressure at the dissolving stage was 112 $kg/cm^2$ and the pressure in the pressure letdown chamber was 93 $kg/cm^2$.

The resulting nonwoven fabric was with a very good state of fibrillation of the filaments without colouring. Moreover, th filaments were bonded throughout the entire surfaces and, therefore, the strength of the nonwoven fabric was high and both moisture permeability and waterproof pressure were high as well. It was also confirmed that the nonwoven fabric was able to be clearly dyed with a disperse dye. Properties of the nonwoven fabric were as follows.

Specific surface area: 31 $m^2/g$

KS Strength of the nonwoven fabric (MD/CD): 36.3/37.4 kg/5 cm

Elongation of the nonwoven fabric (MD/CD): 21/29%

Apparent density: 0.37 $g/cm^3$

Moisture permeability: 292 $g/m^2/hr$

TABLE 2

| | Mixing | | | Properties of Nonwoven Fabric | | | | | |
|---|---|---|---|---|---|---|---|---|---|
| | Ratio of Polymers (PET/PE) (%) | Pressure of Letdown Chamber ($kg/cm^2$) | Specific Surface Area ($m^2/g$) | KS Strength (MD/CD) (kg/5 cm) | Tensil Elongation (MD/CD) (%) | Apparent Density (*) | Moisture Permeability (**) | Waterproof Pressure (cm) | Dyeing Ability |
| Comparative Example 3 | 0/100 | 90 | 17 | 46.2/47.1 | 29/30 | 0.43 | 230 | 110 | x |
| Example 13 | 5/95 | 91 | 18 | 46.9/47.7 | 28/29 | 0.42 | 240 | 130 | Δ |
| Example 14 | 15/85 | 91 | 36 | 48.3/49.8 | 22/25 | 0.41 | 280 | 183 | ○ |
| Example 15 | 50/50 | 92 | 43 | 53.6/55.3 | 21/23 | 0.39 | 315 | 235 | ○ |
| Example 16 | 80/15 | 91 | 34 | 43.2/45.3 | 19/21 | 0.38 | 250 | 165 | ⊙ |
| Example 17 | 95/5 | 92 | 24 | 22.3/25.0 | 14/16 | 0.36 | 100 | 72 | ⊙ |
| Comparative Example 4 | 100/0 | 91 | 18 | 11.7/13.0 | 12/12 | 0.35 | 60 | 35 | ⊙ |

PET: polyethylene terephthalate
PE: polyethylene of high density
*: apparent density ($g/cm^3$)
**: moisture permeability ($g/m^2/hr$)

It is clear from table 2 that, in Examples 13–17, there was a tendency that the more the mixing ratio of the polyester, the better the dyeing ability by a disperse dye and the resulting nonwoven fabric was with a very good state of fibrillated filaments without colouration. Moreover, the filaments were bonded throughout the entire surfaces and, Waterproof pressure: 191 $cmH^2O$ Dyeing ability: ⊙

EXAMPLE 19

A 10-liter autoclave was used and 600 g of polyethylene of high density (melting point: 132° C.; density: 0.96 $g/m^3$; melt index value: 0.8 g/10 min), 900 g of polyethylene terephthalate (melting point: 256° C.; relative viscosity: 1.70) and methylene chloride (a solvent) were filled in this autoclave. Each 0.2% by weight (to the above-mentioned mixed polymers) of isooctyl stearate and isostearyl ester were added as the surface-active agents. The autoclave was closed, then nitrogen was introduced thereinto to make the pressure 20 kg/cm$^2$ and a stirring at a suitable speed was initiated together with a heating. The concentrations of the components were 20% by weight of the polymers and 80% by weight of the solvent.

The time required for rising the temperature from 100° C. to 220° C. was 40 minutes and, when the temperature became 220° C., a stirring was continued for ten minutes to give a homogeneous solution. The gauge pressure at that time was 109 kg/cm$^2$. Then three valves were immediately released by keeping the pressure of the autoclave at 110 kg/cm$^2$ by means of a continuous introducing apparatus of compressed nitrogen gas so that the solution was spun out from three nozzles (hole diameter: 0.75 mm; L/D=1) equipped with a pressure letdown chamber. This was collided with a rotating plate, opened and accumulated on a moving conveyer net to give webs. The pressure of the pressure letdown chamber was 92 kg/cm$^2$.

Then the webs were laminated and passed through a clearance embossing apparatus of an oil pressure type to manufacture nonwoven fabric of a weight of 50 g/m$^2$. The upper roll of the embossing apparatus was an engraved roll while the lower one was a flat roll and both were heating rolls. An embossing process was carried out at the nip pressure of roll axis direction of 20 kg/cm, the temperature of 125° C. and the speed of 10 m/min without taking a clearance between the upper and the lower rolls. The rate of the bonded area of the engraved roll was 25% and the density of the bonded area was 60/cm$^2$.

The resulting nonwoven fabric was with a very good state of fibrillated filaments without colouring. In addition, the filaments were in such a structure that there were many small bonded areas with pressure and, accordingly, the nonwoven fabric was with excellent softness and moisture permeability keeping a practically sufficient strength as the nonwoven fabric. It was also confirmed that the nonwoven fabric was able to be clearly dyed with a disperse dye. The properties of the nonwoven fabric were as follows.

Specific surface area: 31 m$^2$/g

KS Strength of the nonwoven fabric (MD/CD):

17.3/18.6 kg/5 cm

Tensile elongation of the nonwoven fabric (MD/CD):

28/31%

Apparent density: 0.28 g/cm$^3$

Softness at compression: 125 g

Moisture permeability: 250 g/m$^2$/hr

Dyeing ability: ⊙

EXAMPLE 20

The same apparatus as in Example 19 was used and 400 g of polypropylene (melting point: 162° C.; density : 0.910 g/cm$^3$; melt flow rate value: 4 g/10 min), 1,100 g of polyethylene terephthalate (melting point: 256° C.; relative viscosity: 1.6) and methylene chloride ( a solvent) were filled in the autoclave. Each 0.2% by weight (to the above-mentioned mixed polymers) of isooctyl stearate and isostearyl ester were added as the surface-active agents. The autoclave was closed, then nitrogen was introduced into the autoclave until the pressure became 40 kg/cm$^2$ and a stirring at a suitable speed was initiated together with a heating. The concentrations of the mixed polymers and the solvent in the solution were 20% by weight and 80% by weight, respectively.

The time required for rising the temperature from 100° C. to 200° C. was 30 minutes and, when the temperature became 200° C., a stirring was carried out for ten minutes to give a homogeneous solution. The gauge pressure at that time was 118 kg/cm$^2$. Then three valves were released by keeping the pressure of the autoclave at 120 kg/cm$^2$ by means of a continuous introducing apparatus of compressed nitrogen gas and the solution was spun out from three nozzles (hole diameter: 0.75 mm; L/D=1) equipped with a pressure letdown chamber. This was collided with a rotating plate, opened and accumulated on a moving conveyer net to give webs. The pressure in the pressure letdown chamber was 99 kg/cm$^2$. Then the webs were laminated and treated by the same manner as in Example 19 with an exception that the temperature of the embossing process was made 150° C. to give nonwoven fabric with a weight of 100 g/m$^2$.

The resulting nonwoven fabric was with a very good state of fibrillation of the filaments without colouring. Moreover, the filaments were in such a structure that there were many small bonded areas with pressure and, accordingly, the nonwoven fabric maintained a practically sufficient strength and also excellent softness and moisture permeability. It was also confirmed that the nonwoven fabric was able to be clearly dyed with a disperse dye. Properties of the nonwoven fabric were as follows.

Specific surface area: 29 m$^2$/g

KS Strength of the nonwoven fabric (MD/CD):

16.2/17.7 kg/5 cm

Tensile elongation of the nonwoven fabric (MD/CD):

30/33%

Apparent density: 0.29 g/cm$^3$

Softness at compression: 120 g

Moisture permeability: 231 g/m$^2$/hr

Dyeing ability: ⊙

EXAMPLE 21

Nonwoven fabric was manufactured by the same conditions as in Example 20 with an exception that polyethylene terephthalate copolymerized with 5 molar % of sulfoisophthalic acid (melting point: 247° C.; relative viscosity: 1.3) was used and that the dissolving and the spinning temperatures were made 200° C. The pressure at the dissolving stage was 119 kg/cm$^2$ and that of the pressure letdown chamber was 100 kg/cm$^3$.

The resulting nonwoven fabric was with a very good state of fibrillation of the filaments without colouring. Moreover, the filaments were in such a structure that there were many small bonding areas with pressure and, therefore, it maintained a practically sufficient strength as the nonwoven fabric and exhibited excellent softness and moisture permeability. It was also confirmed that the nonwoven fabric was able to be clearly dyed with a cationic dye. The properties of the nonwoven fabric were as follows.

Specific surface area: 28 m$^2$/g

KS Strength of the nonwoven fabric (MD/CD):

14.5/15.7 kg/5 cm

Tensile elongation of the nonwoven fabric (MD/CD):

37/39%

Apparent density: 0.30 g/cm$^3$

Softness at compression: 118 g

Moisture permeability: 247 g/m²/hr

Dyeing ability: ○

EXAMPLES 22–26 AND COMPARATIVE EXAMPLES 5–6

The apparatus of Example 19 was used and polyethylene with high density (melting point 132° C.; density: 0.96 g/cm³; melt index value: 0.6 g/10 min) and polyethylene terephthalate (melting point: 256° C.; relative viscosity:1.4) with varied ratio and 6,200 g (kept constant) of methylene chloride (a solvent) were filled in the autoclave. Each 0.2% by weight (to the above-mentioned mixed polymers) of isooctyl stearate and isostearyl ester were added as the surface-active agents and the autoclave was closed. Then nitrogen was introduced into the autoclave to make the pressure 40 kg/cm² and a stirring at a suitable speed was initiated together with a heating.

The concentrations of he components were as given in Table 3. The time required for rising the temperature from 100° C. to 200° C. was 35 minutes and, when the temperature became 200° C., a stirring was continued for ten minutes to give a homogeneous solution. The gauge pressure at that time was about 110 kg/cm². Then three valves were immediately released keeping the pressure in the autoclave at 110 kg/cm² by means of a continuous introducing apparatus of compressed nitrogen gas to conduct a spinning and, by the same manner as in Example 19, webs were formed and nonwoven fabric was prepared therefrom.

The results are given in Table 3.

In Comparative Example 6, no polyethylene was contained at all and, therefore, the resulting nonwoven fabric was with good dyeing ability with a disperse dye but the fibrillated state was not so good and, in addition, both strength and moisture permeability were low.

EXAMPLE 27

Nonwoven fabric was manufactured under the same conditions as in Example 24 with an exception that polybutylene terephthalate (melting point: 228° C.; relative viscosity: 1.7) was used and the dissolving and the spinning temperatures were made 200° C. The pressure at the dissolving stage was 112 kg/cm² and the pressure of the pressure letdown chamber was 93 kg/cm².

The resulting nonwoven fabric was with a very good state of fibrillation of the filaments without colouring. Moreover, the filaments were in such a structure that there were many small bonded areas with pressure and, therefore, the nonwoven fabric kept a practically sufficient strength and exhibited excellent softness and moisture permeability. It was also confirmed that the nonwoven fabric was able to be clearly dyed with a disperse dye. The properties of the nonwoven fabric were as follows.

Specific surface area: 31 m²/g

KS Strength of the nonwoven fabric (MD/CD): 15.3/16.5kg/5 cm

Tensile elongation of the nonwoven fabric (MD/CD): 37/39%

Apparent density: 0.27 g/cm³

TABLE 3

| | | | | Properties of Nonwoven Fabric | | | | | |
|---|---|---|---|---|---|---|---|---|---|
| | Mixing Ratio of PET/PE (%) | Pressure of Letdown Chamber (kg/cm²) | Specific Surface Area (m²/g) | KS Strength (MD/CD) (kg/5 cm) | Tensil Elongation (MD/CD) (%) | Apparent Density (*) | Softness at Compression (g) | Moisture Permeability (**) | Dyeing Ability |
| Example 22 | 5/95 | 91 | 28 | 16.9/17.7 | 38/39 | 0.32 | 195 | 210 | Δ |
| Example 23 | 15/85 | 91 | 36 | 18.3/19.8 | 32/35 | 0.30 | 130 | 250 | ○ |
| Example 24 | 50/50 | 92 | 43 | 23.6/25.3 | 31/33 | 0.26 | 85 | 285 | ○ |
| Example 25 | 85/15 | 91 | 34 | 13.2/15.3 | 29/31 | 0.29 | 100 | 220 | ⊙ |
| Example 26 | 95/5 | 92 | 24 | 12.3/15.0 | 24/26 | 0.33 | 110 | 80 | ⊙ |
| Comparative Example 5 | 0/100 | 90 | 17 | 16.2/17.1 | 39/40 | 0.33 | 210 | 200 | x |
| Comparative Example 6 | 100/0 | 91 | 18 | 8.7/8.0 | 22/22 | 0.35 | 120 | 40 | ⊙ |

PET: polyethylene terephthalate
PE: polyethylene of high density
*: apparent density (g/cm³)
**: moisture permeability (g/m²/hr)

It is clear from Table 3 that, in Examples 22–26, there was a tendency that the more the mixing ratio of polyester, the better the dyeing ability with a disperse dye and the resulting nonwoven fabric was with a very good state of fibrillated filaments without colouring. Moreover, the filaments were in such a structure that there were many small bonded areas with pressure and, therefore, the nonwoven fabric kept a practically sufficient strength and exhibited excellent softness and moisture permeability. It was also confirmed that the nonwoven fabric was able to be clearly dyed with a disperse dye.

In Comparative Example 5, the resulting nonwoven fabric was with a good fibrillated state and the strength was relatively high but, since it contained no polyester at all, the dyeing ability was no good.

Softness at compression: 109 g

Moisture permeability: 262 g/m²/hr

Dyeing ability: ⊙

EXAMPLES 28–34

In the manufacture of nonwoven fabric according to Example 25, the type of the embossing rolls was changed so that the ratio of the bonded area and the density of the bonded areas were changed. The results are given in Table 4.

It is clear from Table 4 that the nonwoven fabric of Examples 28–33 maintained a practically sufficient strength and exhibited excellent softness and moisture permeability with a tendency that the more the ratio of bonded area and the density of the bonded area, the more the strength and the less the softness.

In Example 34, the ratio of the bonded areas became 100% due to a bonding with pressure only by a flat roll and, accordingly, the softness of the resulting nonwoven fabric was somewhat inferior though it still exhibited practically sufficient strength and moisture permeability.

TABLE 4

| | Ratio of Bonded Area (%) | Density of Bonded Area (/cm$^2$) | Specific Surface Area (m$^2$/g) | Properties of Nonwoven Fabric: KS Strength (MD/CD) (kg/5 cm) | Tensil Elongation (MD/CD) (%) | Apparent Density (*) | Softness at Compression (g) | Moisture Permeability (**) | Dyeing Ability |
|---|---|---|---|---|---|---|---|---|---|
| Example 28 | 50 | 80 | 34 | 26.9/27.7 | 22/23 | 0.36 | 190 | 280 | ⊙ |
| Example 29 | 40 | 60 | 34 | 20.8/22.9 | 26/27 | 0.34 | 180 | 290 | ⊙ |
| Example 30 | 33 | 60 | 34 | 18.4/19.8 | 28/30 | 0.32 | 145 | 295 | ⊙ |
| Example 31 | 17 | 60 | 34 | 13.2/15.1 | 29/31 | 0.29 | 100 | 300 | ⊙ |
| Example 32 | 17 | 17 | 34 | 12.3/24.0 | 34/36 | 0.23 | 70 | 335 | ⊙ |
| Example 33 | 5 | 40 | 34 | 6.2/7.1 | 32/33 | 0.26 | 85 | 310 | ⊙ |
| Example 34 | 100 | — | 34 | 43.2/45.3 | 19/21 | 0.38 | 715 | 250 | ⊙ |

PET: polyethylene terephthalate
PE: polyethylene of high density
*: apparent density (g/cm$^3$)
**: moisture permeability (g/m$^2$/hr)

We claim:

1. A filament having a fine fibrillated structure comprising a plexifilamentary structured polyolefin element and a plexifilamentary structured polyester element, said polyolefin element and said polyester element being present in a ratio within a range of from 5/95 to 95/5 by weight.

2. A filament according to claim 1, in which the polyolefin is any one of polyethylene, polypropylene, a copolymer mainly comprising ethylene and a copolymer mainly comprising propylene.

3. A filament according to claim 1, in which the polyester is any one of polyethylene terephthalate and polybutylene terephthalate.

4. A filament according to claim 1, in which the mixing ratio of the polyolefin to the polyester in the polymer mixture is within a range of from 15/85 to 85/15 by weight.

5. A filament according to claim 2, in which the polyester is either one of polyethylene terephthalate and polybutylene terephthalate.

* * * * *